US006705880B2

(12) United States Patent
Rhude

(10) Patent No.: US 6,705,880 B2
(45) Date of Patent: Mar. 16, 2004

(54) MALE PLUG PROTECTOR FOR TRAILER WIRING HARNESS

(76) Inventor: Douglas R. Rhude, R & H Specialities, Inc., Elkhart, IN (US) 46514

( * ) Notice: Subject to any disclaimer, the term of this patent is extended or adjusted under 35 U.S.C. 154(b) by 0 days.

(21) Appl. No.: 10/422,999

(22) Filed: Apr. 25, 2003

(65) Prior Publication Data

US 2003/0186564 A1 Oct. 2, 2003

Related U.S. Application Data

(63) Continuation-in-part of application No. 10/073,412, filed on Feb. 13, 2002, now Pat. No. 6,638,083.
(60) Provisional application No. 60/279,667, filed on Mar. 30, 2001.

(51) Int. Cl.[7] ..... H01R 13/44
(52) U.S. Cl. ..... 439/144; 439/35; 439/142
(58) Field of Search ..... 439/35, 34, 142, 439/138, 144, 147, 135; 220/242

(56) References Cited

U.S. PATENT DOCUMENTS

| | | | | |
|---|---|---|---|---|
| 3,176,257 A | | 3/1965 | Introvigne | |
| 3,482,203 A | | 12/1969 | Whitright | |
| 4,017,136 A | | 4/1977 | Sassgen | |
| 4,738,641 A | | 4/1988 | Eversole, Jr. | |
| 4,770,644 A | | 9/1988 | Feder | |
| 5,380,209 A | | 1/1995 | Converse, Jr. et al. | |
| 5,443,389 A | | 8/1995 | Hughes | |
| 5,501,607 A | | 3/1996 | Yoshioka et al. | |
| 5,605,466 A | * | 2/1997 | Devlin et al. | 439/144 |
| 5,630,728 A | | 5/1997 | Watters, Jr. | |
| 5,722,854 A | | 3/1998 | Geisler | |
| 5,800,188 A | | 9/1998 | Barber et al. | |
| 6,447,302 B1 | * | 9/2002 | Davis | 439/35 |
| 6,457,843 B1 | * | 10/2002 | Kester et al. | 439/147 |
| 6,638,083 B2 | * | 10/2003 | Rhude | 439/35 |

FOREIGN PATENT DOCUMENTS

DE 3327087 C1 * 8/1984 ..... H01R/13/70

* cited by examiner

*Primary Examiner*—Renee Luebke
*Assistant Examiner*—Felix O. Figueroa
(74) *Attorney, Agent, or Firm*—Richard C. Litman

(57) ABSTRACT

A male plug protector for trailer wiring harness connection plug simulating a female type receptacle and is vertically mounted on the hitch frame with the upper end closed for protecting a plug when not in use. In one embodiment the male plug end is cylindrical and is retained in the protector by the spring action of the cover and a protrusion on the interior of the cover corresponding to a projection located on the male plug wall. The user pulls back the cover and to remove the plug. In another embodiment, the male plug is linear and retained in the protector by the spring action of the cover and a lower wall holding the base of the male plug and having a central opening for passage of the male plug electrical wiring harness closing over the male plug. The wiring harness plug's electrical connectors are protected when not in use.

20 Claims, 12 Drawing Sheets

MALE PLUG PROTECTOR FOR TRAILER WIRING HARNESS

CROSS-REFERENCE TO RELATED APPLICATION

This application is a Continuation-In-Part of Ser. No. 10/073,412, filed Feb. 13, 2002 now U.S. Pat. No. 6,638, 083, which claims the benefit of U.S. Provisional Patent Application Serial No. 60/279,667, filed Mar. 30, 2001.

BACKGROUND OF THE INVENTION

1. Field of the Invention

The present invention relates to electrical plug protectors. More particularly, the present invention relates to male plug protectors for trailer wiring harness connection plugs.

2. Description of Related Art

When disconnecting a trailer from a towing vehicle, it would be helpful to provide a device mounted on the trailer in which the male plug of the trailer may be stored when the trailer is not in use. The device should provide a relatively snug fit while protecting the electrical plug from exposure to the weather, etc.

U.S. Pat. No. 3,176,257, issued Mar. 30, 1965 describes a bracket for holding trailer plugs of tractor-trailer vehicles. The plug holder '257 patent is designed to rotatably receive a specific type of plug, and the plug holder has no covering to keep out dust, etc.

U.S. Pat. No. 3,482,203, issued Dec. 2, 1969, to Whitright describes an electrical connector-storing device for trailers. This device has no cover for protection to keep out dust, etc. when not in use, and relies on a ring or bail to hold the male connector. The ring device requires a particular type of plug shape where it is attached to the wire conduit in order to maintain the plug in the hood or protector.

U.S. Pat. No. 4,017,136, issued Apr. 12, 1977 to Sasgen, describes a male plug holder for holding a plug for a locomotive control cable when not in use. The male plug holder is oriented in a forward position, thus allowing rain or other environmental hazards into the plug. The plug holder of the '136 patent is designed for a particular plug for a train locomotive and would not be practical for vehicle-pulled trailer connectors.

U.S. Pat. No. 4,738,641, issued Apr. 19, 1988, to Eversol, Jr., describes a spring loaded trailer electrical connector protector device for protecting male trailer connectors when not in use. The '641 device requires wings which fit into notches at the lower end of the device which is an uncommon feature on trailer connectors.

U.S. Pat. No. 4,770,644, issued Sep. 13, 1988, to Feder, describes a typical trailer plug connector of the type contemplated by the present invention and a receiving female connector having a hinged spring cover.

U.S. Pat. No. 5,380,209, issued Jan. 10, 1995, to Donvers, Jr. et al. describes a trailer connector housing which has an upward opening lid and side slots to receive electrical wires, and, a screw-on protector and casing for attachment to the vehicle. The trailer connector housing of the '209 patent is subject to entrance of environmental rain or dust.

U.S. Pat. No. 5,630,728, issued May 20, 1997, to Watters, Jr., describes a plug holder for trailers or towing vehicles. The '728 holder is vertically or horizontally mounted, allowing entrance of rain or mud, and is keyed to a particular connector.

U.S. Pat. No. 5,722,854, issued Mar. 3, 1998, to Geisler, describes a sleeve type trailer plug holder having an end cap for sealing the open end. The '854 device requires a snug fit between the plug holder and the trailer plug. The end cap must be inserted to assure protection from the elements. The end cap is subject to accidental removal, allowing the elements to enter the plug holder. The user may also forget to fasten the end cap securely.

U.S. Pat. No. 5,800,188, issued Sep. 1, 1998, to Barber et al., describes a trailer tow inter-connector having a spring-loaded cover similar to that of the present invention.

None of the above inventions and patents, taken either singly or in combination, is seen to describe the instant invention as claimed.

SUMMARY OF THE INVENTION

The present invention is a vertically oriented male plug protector for a trailer wiring harness connection plug having a female type receptacle with a spring-biased hinged cover at its lower end. The upper end is closed. The device has a back plate with mounting holes for mounting to a trailer near the hitch end or on the hitch frame. When the trailer is not in use, the cover is pulled back and the male wiring harness plug is inserted into the female receptacle. In one embodiment the male plug end is retained in the protector by the spring action of the cover and a protrusion on the interior of the cover corresponding to a projection located on the male plug wall. To remove the plug, the user pulls back the cover and removes the plug. In another embodiment, the male plug end is retained in the protector by the spring action of the cover and a lower curved wall corresponding to the base of the male plug and having a centrally disposed opening for passage of the male plug electrical wiring harness closing over the male plug. The electrical wiring harness plug is retained within the protector to prevent environment damage from occurring to the plug's electrical connectors when the trailer is not in use. The protector has no electrical connections.

Accordingly, it is a principal object of the invention to provide a protector apparatus for safe storage of a male electrical plug for a trailer.

It is another object of the invention to provide a plug protector as above which mounts on the front wall or the hitch frame of a trailer.

It is a further object of the invention to provide a plug protector as above where the male plug is inserted upward into the protector and the protector completely encloses the upper portion of the plug.

Still another object of the invention is to provide a plug protector as above having a biased, hinged lower cover which may be pulled open to allow entry of the male plug, and then partially allowed to close by spring bias to retain the male plug within the plug protector.

Yet another object of the invention is to provide another embodiment of a plug protector where the male plug is inserted upward into the protector and a biased, hinged lower cover which may be pulled open to allow the entry of the male plug and then allowed to completely close around the plug to retain the male plug within the plug protector.

It is yet a further object of the invention to provide plug protectors as above having tabs on the spring biased cover which may be employed to release the male plug for withdrawal, and then released to allow the spring biased cover to closing over the lower portion of the plug receptacle to avoid entry of dirt, etc.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a vertically oriented, male plug protector for a trailer wiring harness connection plug having a female type receptacle with a spring-biased hinged cover at its lower end. The upper end is closed. The device has a back plate with mounting holes for mounting to a trailer near the hitch end. When the trailer is not in use, the cover is pulled back and the male wiring harness plug is inserted. In one embodiment the male plug end is retained in the protector by the spring action of the cover and a protrusion on the interior of the cover corresponding to a projection located on the male plug wall. In another embodiment of the invention the male plug end is retained in the protector by the spring action of the cover and a lower curved wall corresponding to the base of the male plug closing over the male plug. To remove the plug, the user pulls back the cover and removes the plug. The electrical wiring harness plug is retained within the protector to prevent environment damage from occurring to the plug's electrical connectors when the trailer is not in use. The protector has no electrical connections.

Figure 1:
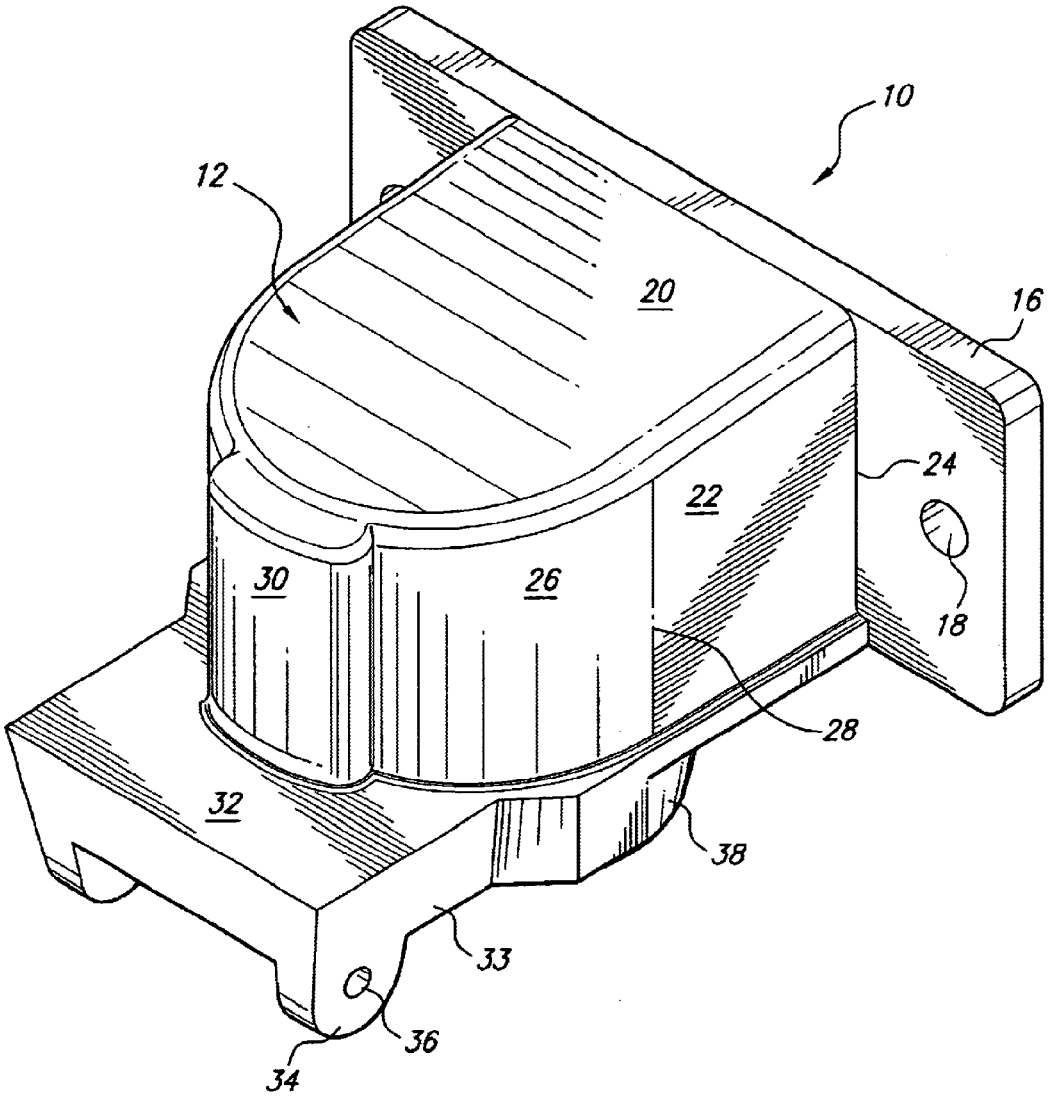
FIG. 1 is a perspective view of a male plug protector for trailer wiring harness according to the present invention with the lower lid removed.
Figure 2:
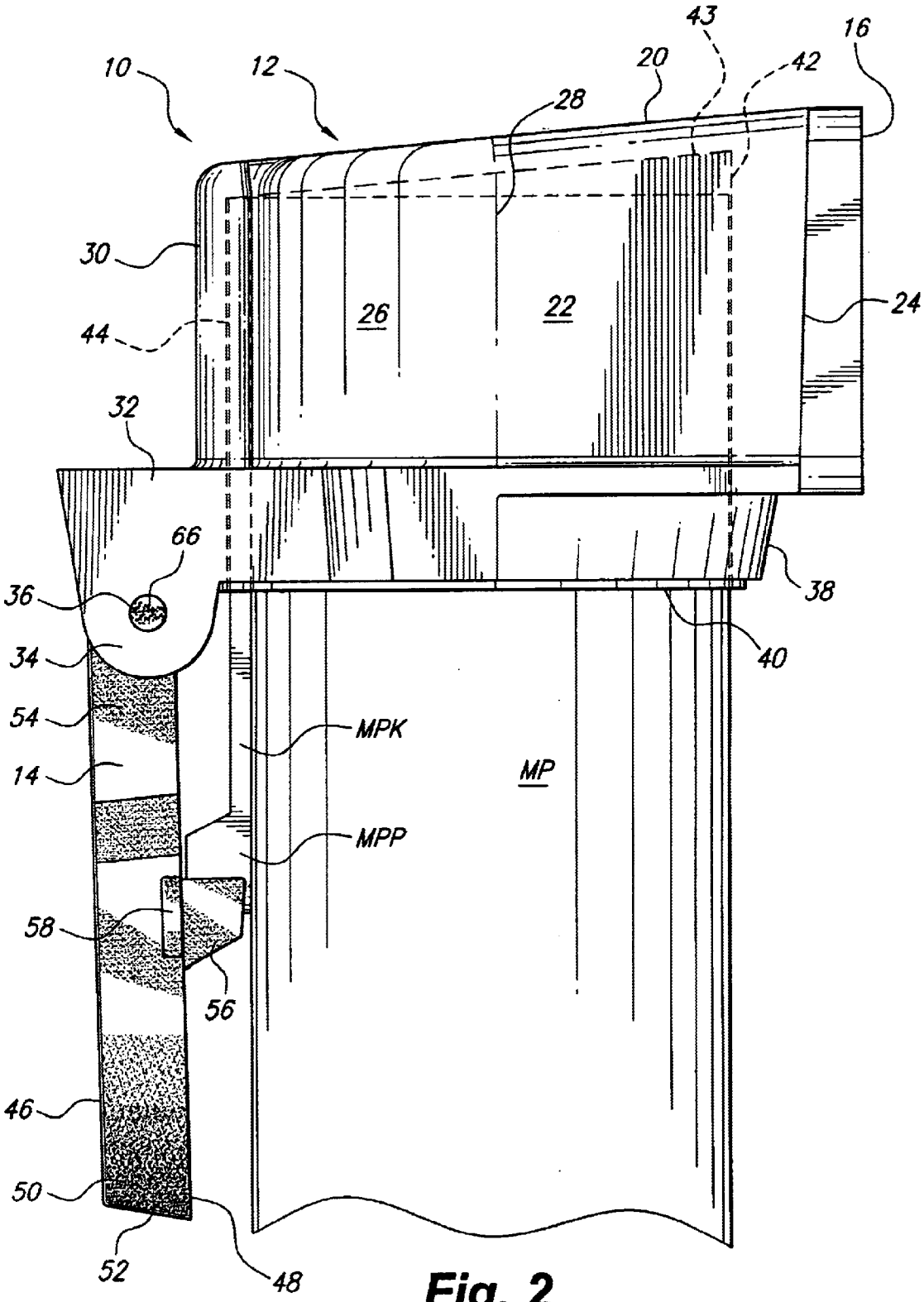
FIG. 2 is a side view in elevation of the present invention shown with a male plug inserted therein.

Referring to FIGS. 1–4, various perspective views of plug protector 10 are shown wherein plug protector 10 comprises vertically oriented male plug receptacle 12, having a spring biased, hinged lower cover 14 (see FIG. 2). Receptacle 12 has a vertically oriented back plate 16 having mounting holes 18 for mounting on a sidewall of a trailer, etc. Plug receptacle 12 has a top portion 20 acting as a closed, fixed upper wall for receptacle 12 and extending to said back plate 16 for additional support.

Receptacle back plate support walls 22 are vertically oriented and normal to said back plate 16 and extend from support wall back plate connections 24 to respective tangential intersections 28 on vertically oriented receptacle cylindrical portion 26 at the respective ends of a diameter parallel to said back plate 16, said support walls 22 connecting along cylindrical portion 26 at support wall cylindrical intersections 28.

Receptacle top portion 20 covers said cylindrical portion 26 and extends between support walls 22 and said back plate 16, thus forming an inverted "U"-shaped support between said cylindrical portion 26 and said back plate 16. Cylindrical portion 26 of receptacle 12 has a groove portion 30 extending vertically along cylindrical portion 26 at a location opposite back plate 16. Receptacle lower plate 32 defines the lower end of cylindrical portion 26, and comprises lower plate extended portion 33 extending outward from said cylindrical portion 26 and which supports lower plate hinge portion 34 having axle receiver 36 for connection with spring biased, hinged cover 14.

Receptacle lower plate 32 includes lower plate plug receiving portion 38 opposite hinge portion 34 and includes lower plate under portion 39 (see FIG. 4) extending from the receptacle cylindrical portion 26 to back plate 16, forming a boxlike structure with receptacle back plate support walls 22 and receptacle top portion 20. Receptacle cylindrical portion 26 of lower plate 32 is cut away to form a semicircular portion extending from tangential intersections 28 to back plate 16, thus forming under portion 39. The lower plate plug receiving portion 38 of lower plate 32 serves as a lower extension of cylindrical portion 26 and forms lip 40 extending from bottom plate lower surface 41 at the lower opening inner cylindrical surface 42. The outer surface plug receiving portion 38 is conically shaped in its semicircular portion, tapering inwardly from lower plate under portion 39 to lower surface 41 (see FIG. 4).

Figure 3:
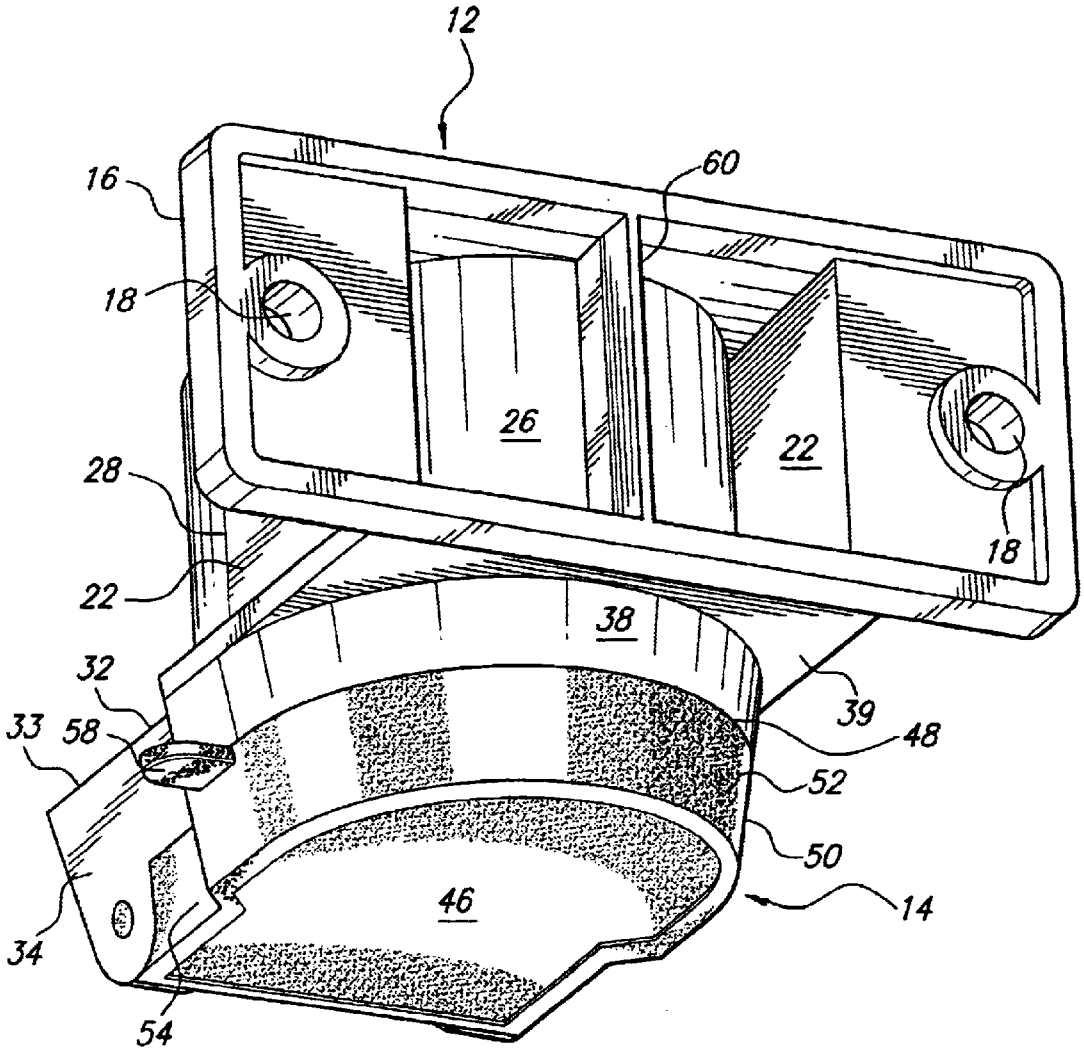
FIG. 3 is a bottom rear view in perspective of the present invention with the lower cover closed.

Referring particularly to FIGS. 2 and 3, there is shown a side view in elevation of the inventive plug protector 10 with a male plug inserted therein, and a bottom rear view in perspective of the present invention with the bottom cover closed, respectively. Male plug MP, having male plug key MPK, is shown inserted into receptacle cylindrical portion 26 along inner cylinder surface 42, having receptacle key receiver groove 44, formed within groove portion 30 and is sized and configured so as to receive male plug MP. Protrusion 56 protrudes from cover 14 (see FIG. 5) and is so configured as to interlock with male plug projection MPP, located at the base of key MPK, when male plug MP is inserted upward into receptacle 12 (see FIG. 2). Inner cylindrical surface 42 (see FIG. 4) and inner cylinder top surface 43 provide clearance for male plug MP. A lip 48 on hinged cover 14, forms an overlapping seal with cylindrical portion lip 40 when cover 14 is in the closed position.

Figure 4:
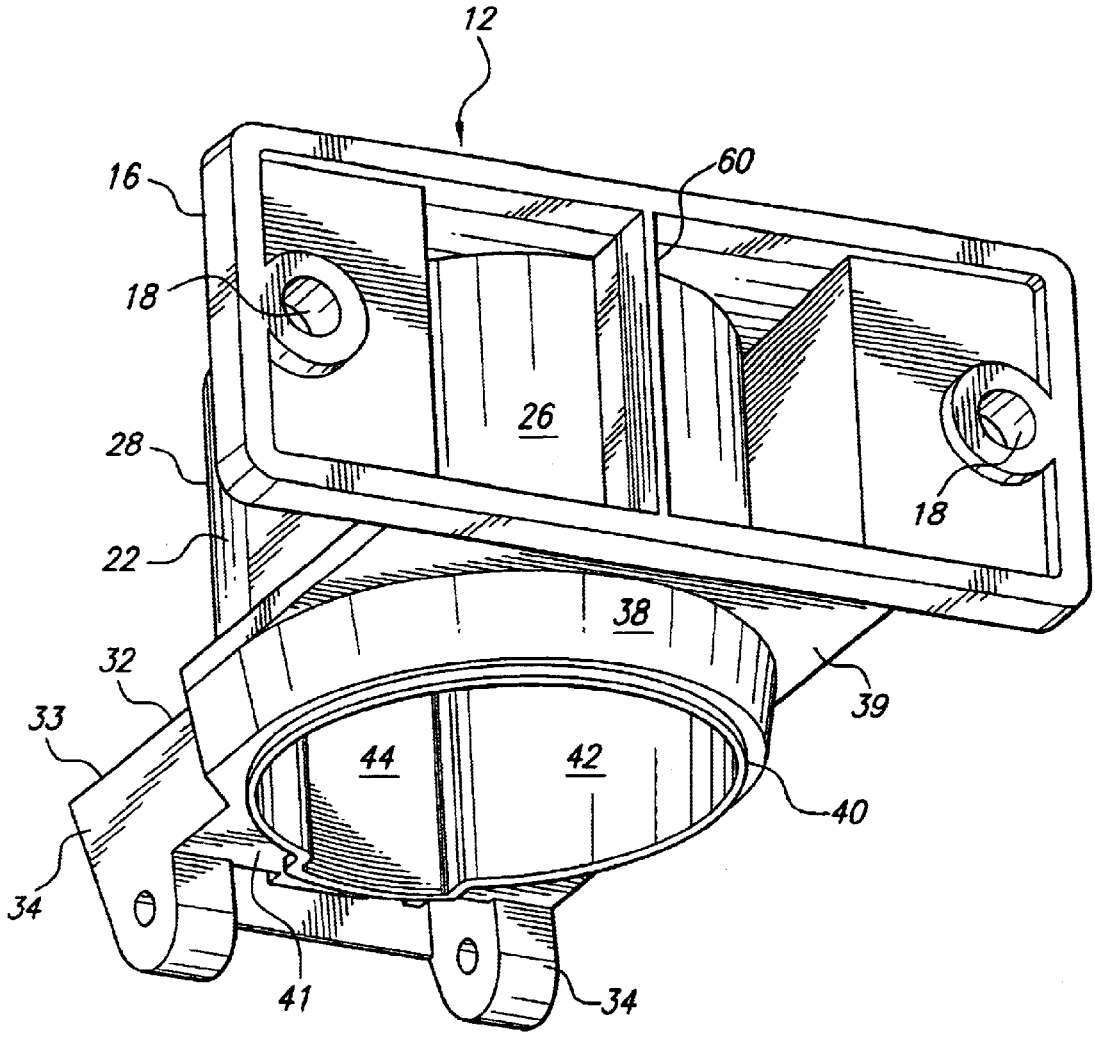
FIG. 4 is a bottom rear view in perspective of the present invention, absent the lower lid.

Referring, particularly, to FIG. 4, there is shown a bottom rear view of the plug holder 10 of the present invention without the hinged cover 14 and wherein receptacle cylindrical portion 26 features receptacle inner cylinder 42, having receptacle key receiver groove 44. Inner cylinder 42 is of such dimensions as to receive standard male electrical plug MP having a male plug key MPK and being useful for a trailer. Central support wall 60 is located parallel to back plate support walls 22 and extends between receptacle cylindrical portion 26, receptacle top portion 20, lower plate 29 and back plate 16. For ease of construction, the portion of the back plate between support walls 22, receptacle top portion 20 and lower plate 39 and receptacle cylindrical portion 26 may be deleted.

Figure 5:
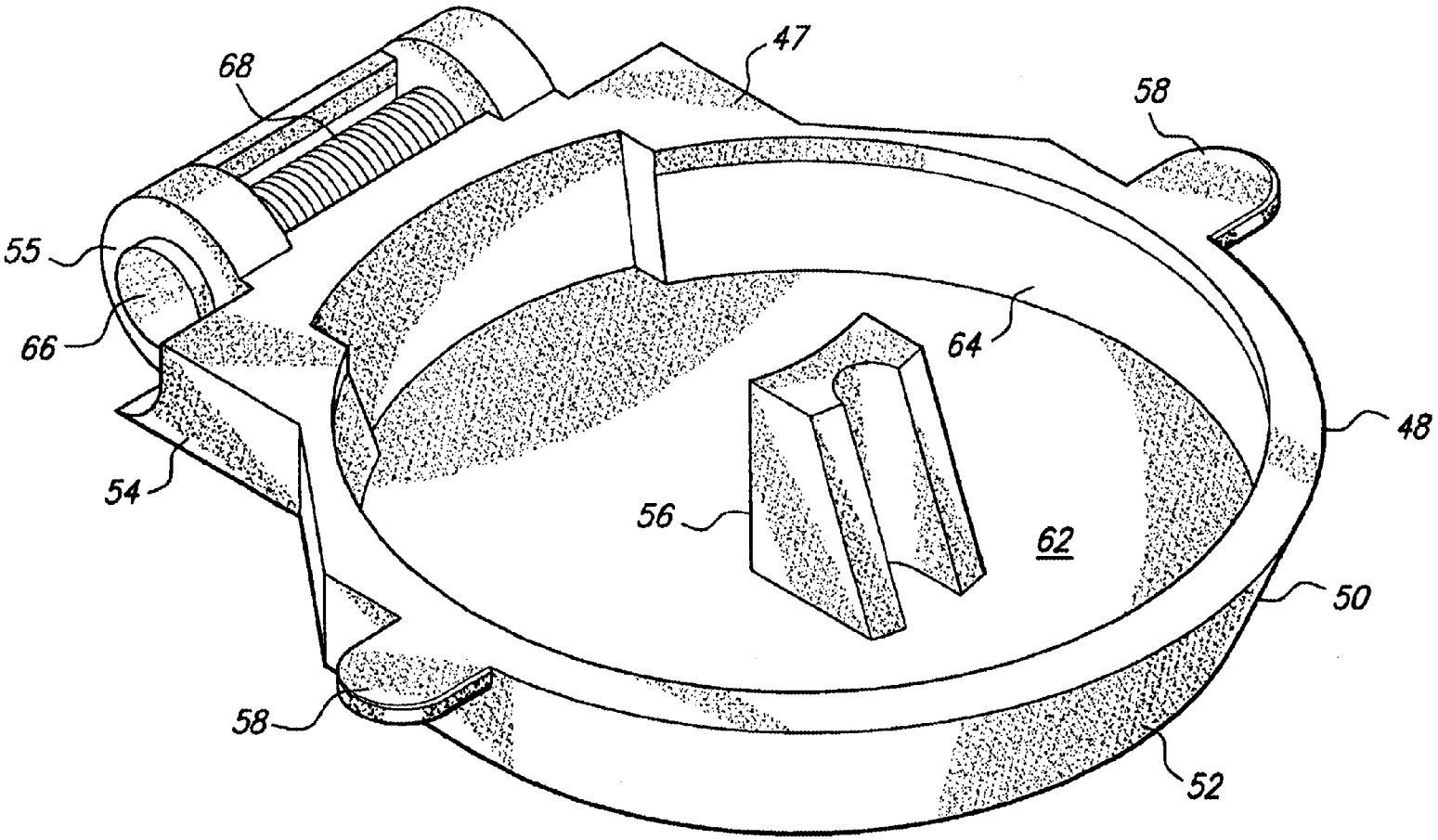
FIG. 5 is a perspective view of the bottom lid of the present invention showing the axle and spring which forms a hinge with the receptacle portion of the plug protector.
Figure 6:
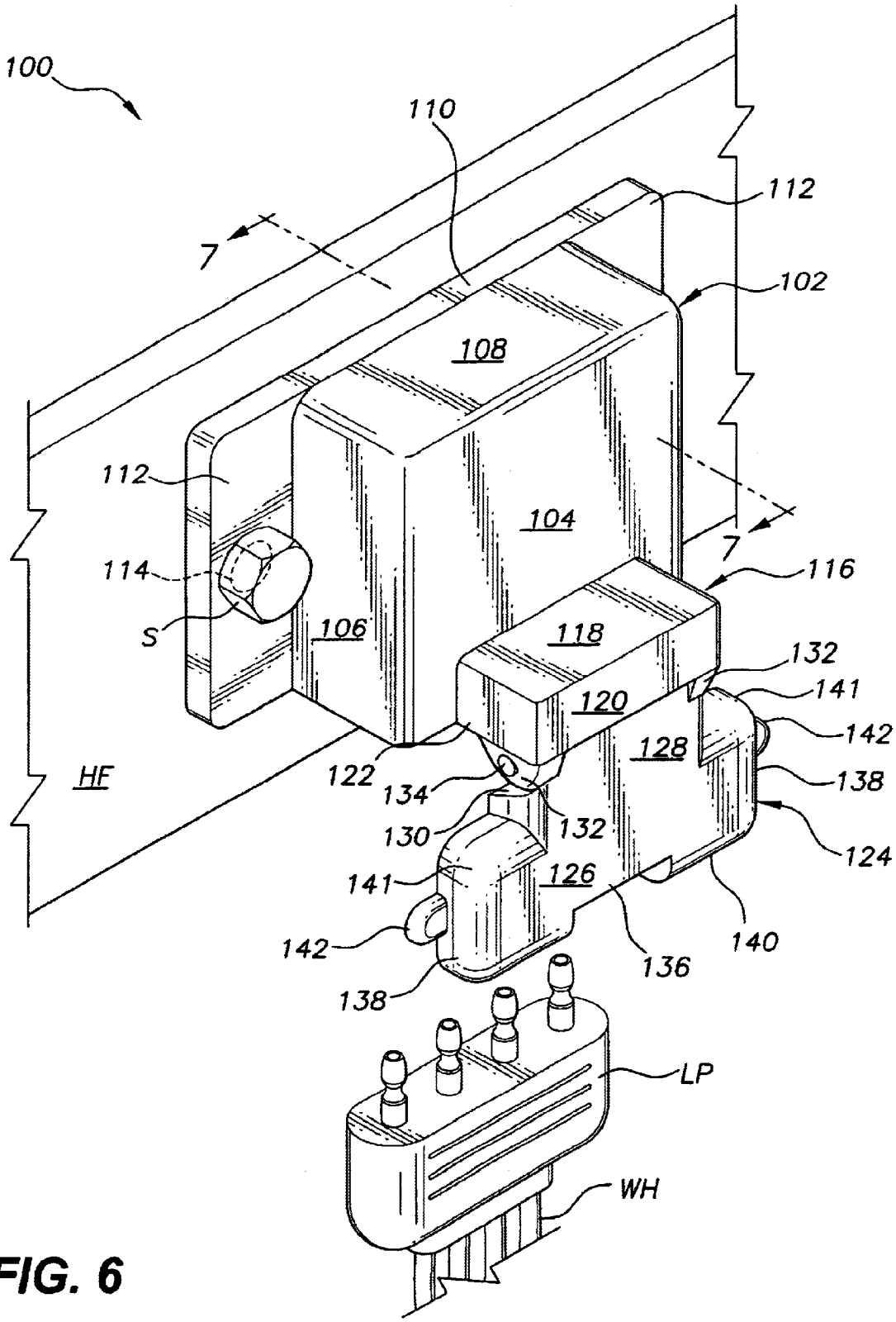
FIG. 6 is an environmental perspective view of another embodiment of the plug protector of the present invention.

Referring to FIGS. 3 and 5, there are shown perspective views of the spring biased, hinged cover 14 of the present invention. Cover 14 is a generally flat plate having a plug receiver cover portion 50, an extended portion 54 and a hinge portion 55 and having a lower surface 46 and an upper surface 47, generally corresponding in shape to bottom plate lower surface 41.

Plug receiver cover portion 50 is generally cylindrical, having an outer sidewall 52. The cover upper surface 47 defines a lip 48 surrounding a recess within plug receiving cover portion 50 and extended portion 54 and shaped for receiving lip 40 of lower plate receiving portion 38. The recess has inner end wall 62 at its base and is defined by hinged cover inner recess wall 64. Inner end wall 62 supports centrally located hinged wall protrusion 56 protruding upward from inner end wall 62 and which is so configured as to interlock with male plug projection MPP when male plug MP is inserted into receptacle 12 (see FIG. 2). Axle 66 is fixedly mounted within axle receiver 36 of lower plate hinge portion 34 and for rotation within cover hinge portion 55. Axle 66 is surrounded by hinge spring 68 and is so located and configured as to maintain a closing bias on hinged cover 14 in a known manner. Plug receiver cover portion outer sidewall 52 is conical in shape, tapering inwardly from cover upper surface 47 to lower cover outer wall 46. Inner recess wall 64 may be conical in shape, corresponding to outer sidewall 52. Pull tabs 58 are distributed around outer sidewall 52, extending outward from lower cover lip 48.

In operation, plug protector 10 is mounted in an appropriate place, such as a front wall of a trailer, by means of back plate 16 such that receptacle 12 may receive a standard male plug MP from below, i.e., receptacle cylindrical portion 26 is installed in a vertical orientation and spring biased, hinged cover 14 is hingedly attached at the base of the receptacle 12. Hinged cover 14 is opened so as to rotate around the axle 66 by pulling on hinged wall pull tabs 58 against the force of spring 68 to a male plug insert and removal position. Male plug MP is inserted upwards within receptacle inner cylinder 42 and along receptacle key receiver groove 44 until male plug projection MPP passes hinged wall protrusion 56 of spring biased, hinged cover 14. The bias from spring 68 allows projection 56 of cover 14 to close over male plug projection MPP to a male plug retention position, thus retaining male plug MP within the plug protector 10.

When it is desired to remove male plug MP from plug protector 10, spring biased, hinged cover 14 is pulled against the bias of spring 68 by means of pull tabs 58, until protrusion 56 of cover 14 clears the male plug projection MPP of male plug MP at the male plug insert and removal position. The male plug MP may then be withdrawn for connection with the towing vehicle or other source of electricity. The spring 68 automatically closes cover 14 such that lower cover upper surface 47 closes against lower plate lower surface 41 and lip 48 of cover 14 closes over lip 40 of lower plate plug receiving portion 38 of receptacle 12, thus sealing the protector against entry of dirt, etc.

Referring to FIGS. 6–12B there are shown views of another embodiment of the present invention for receiving another conventional trailer wiring plug wherein the contacts are a line and they are embedded in a generally linear plug LP of a wiring harness WH. The plug is typically rounded at its ends and at its neck where the wiring harness WH enters the plug. Although four lead wires and contacts are shown, the inventive plug receiver may accommodate similar plugs having more or fewer contacts and lead wires. The linear plug protector 100 is vertically disposed, being attached by screws S such as self tapping screws to a vertical surface such as hitch frame HF or a fifth wheel box (not shown) and includes a rectangular plug receiver 102 having a front wall 104, side walls 106, and a top wall 108 and being integral with a plug receiver mounting plate 110, the bottom being open to receive plug LP.

Figure 7:
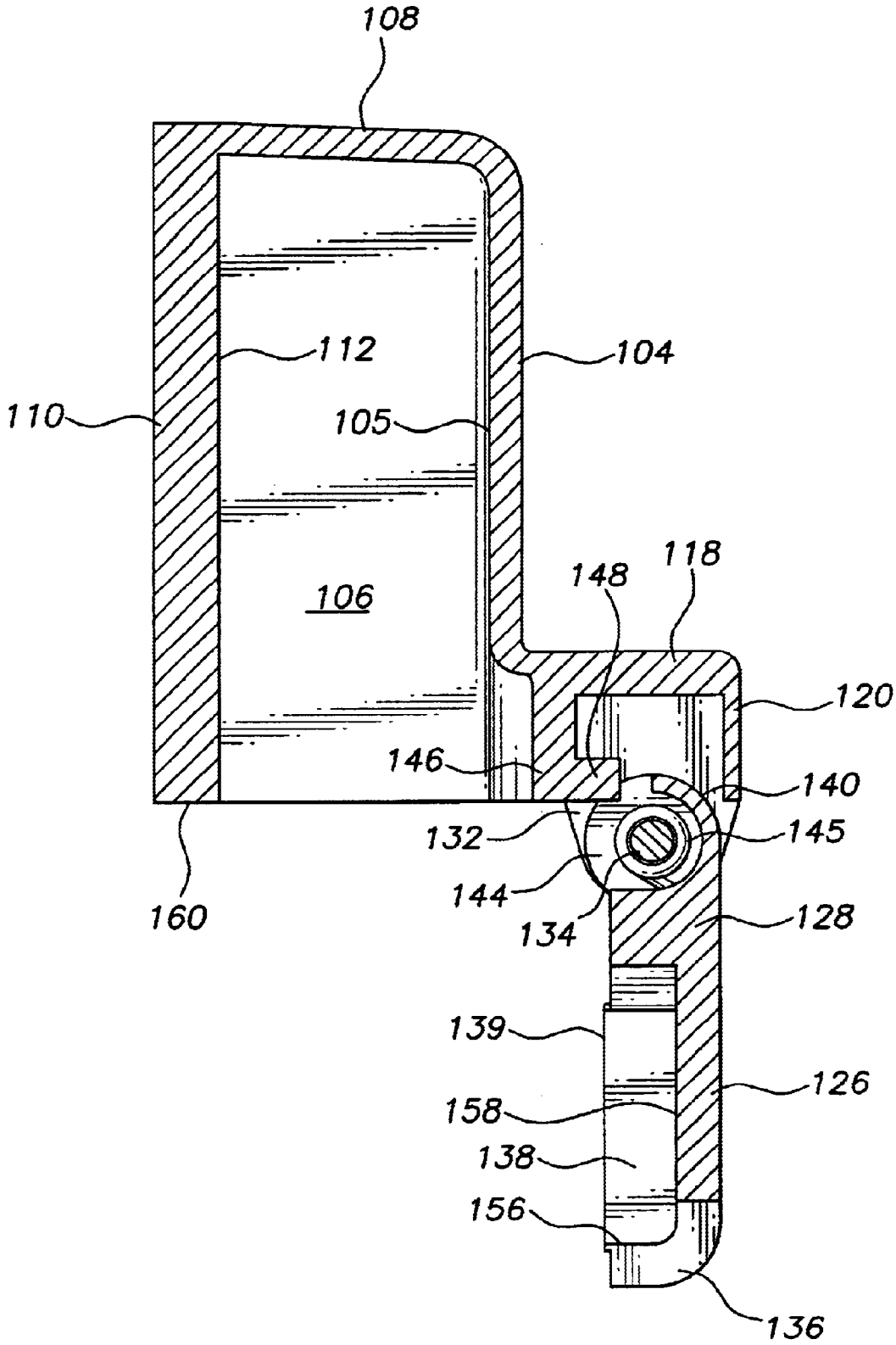
FIG. 7 is a section view taken along the line 7—7 of FIG. 6.
Figure 8:
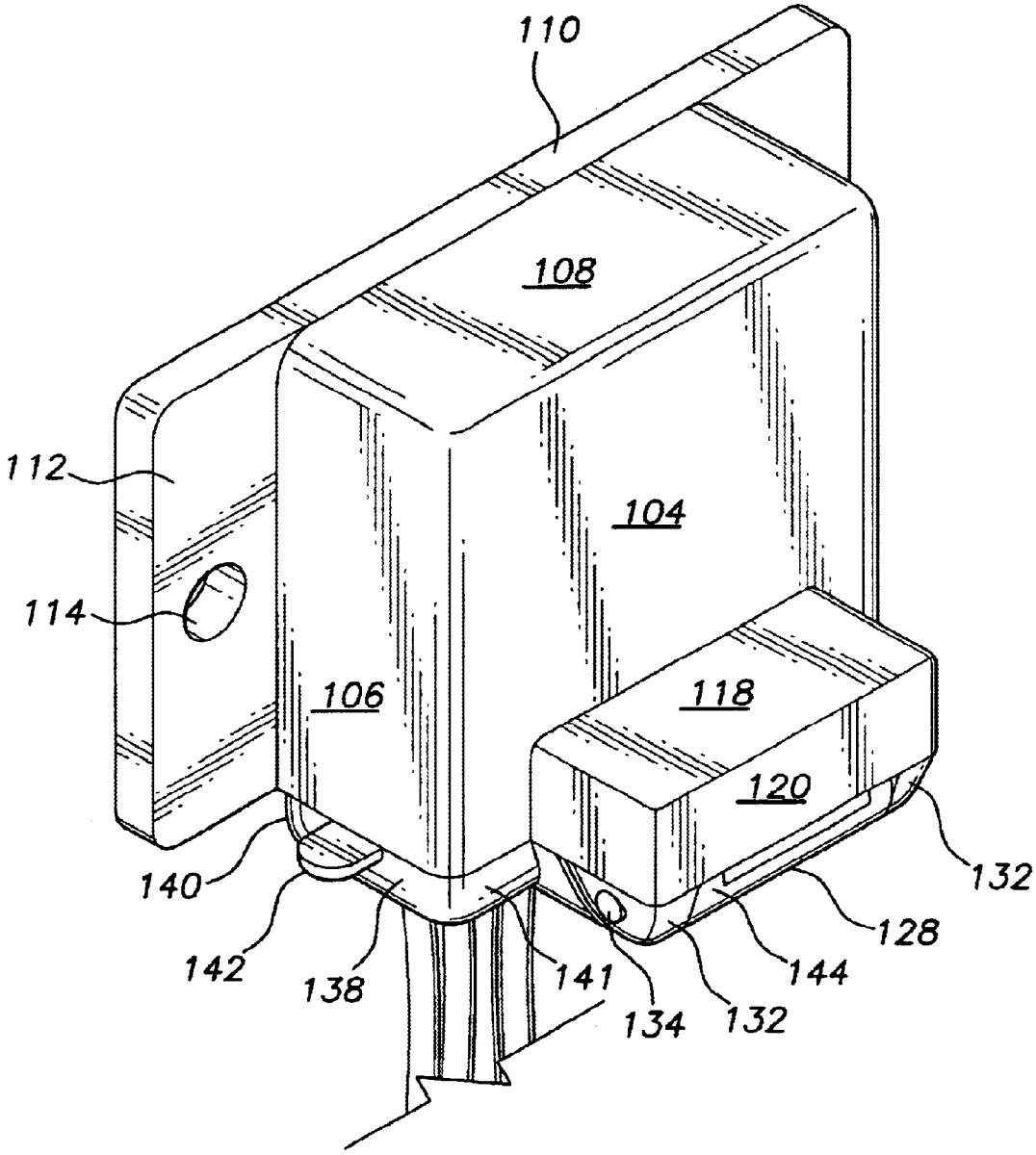
FIG. 8 is a perspective view of the plug protector of FIG. 6 with the cover closed over the plug.

Mounting plate 110 extends horizontally beyond sidewalls 106, forming mounting plate extension portions 112 on each side of plug receiver 102, each having at least one mounting bore 114 located therein for attaching the plug receiver 102 to hitch frame HF. As best seen in FIG. 7, top wall 108 slopes slightly forward to allow water to readily drain off the plug receiver.

Figure 12A:
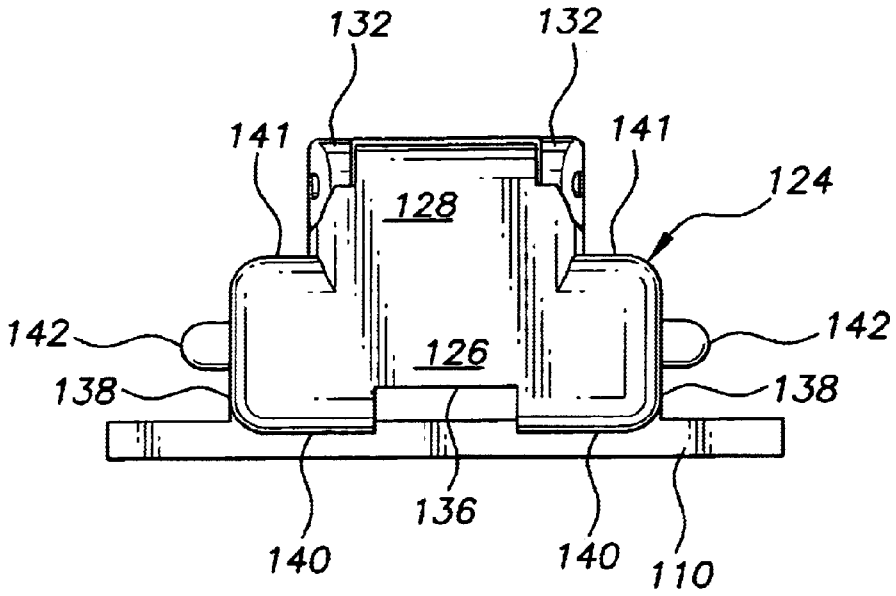
FIG. 12A is a bottom view of the plug protector of FIG. 6 with the cover in the closed position.
Figure 12B:
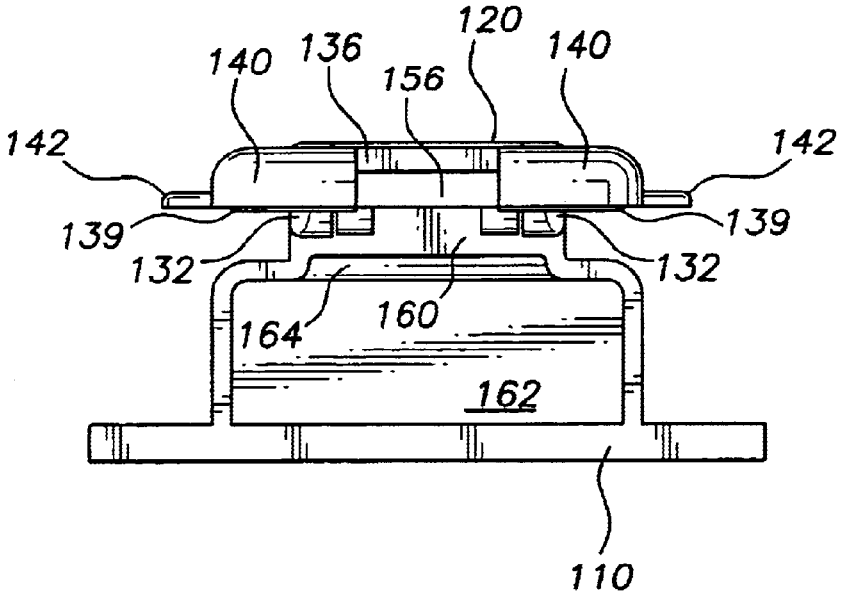
FIG. 12B is a bottom view of the plug protector of FIG. 6 with the cover in the open position.

Plug receiver 102 has a lower cover hinge housing 116 integral with and extending outward from the central portion of the lower end of front wall 104 and even with and sharing a lower end surface 160 (see FIGS. 7 and 12B). Hinge housing 116 is generally rectangular in shape and has a horizontal upper wall 118, a front wall 120, and sidewalls 122 and provides for hinged connection with hinged lower cover 124. Lower cover 124 has a cover portion 126 for covering the lower end of plug receiver 102 and a hinge extension portion 128 for attachment of cover 124 to cover hinge housing 116. Hinge extension portion 128 is spring biased (see FIG. 7) relative to hinge housing 116 so as to maintain cover 126 in a closed position and has hinge grooves 130 to receive hinge housing outer hinge members 132 at each side thereof. A hinge pin 134 extends through and is secured by outer hinges 132 and extends through cover inner hinges 144 (see FIGS. 7 and 8).

Cover 126 has a cutout 136 in cover endwall 140 and extending inward along cover 126 for a distance adequate to receive wiring harness WH. Cover sidewalls 138 extend upward from cover end wall 140 to cover shoulders 141 which intersect with cover hinge extension portion 128. The sidewalls 138, end wall 140 and shoulders curve downward to the lower surface of cover portion 126 and the sidewalls of cover hinge extension portion 128 slope downward to the lower surface thereof. Cover tabs 142 extend outward from each sidewall 138 to assist in opening cover 126 against the spring biased hinge for inserting and removing linear plug LP.

Figure 9:
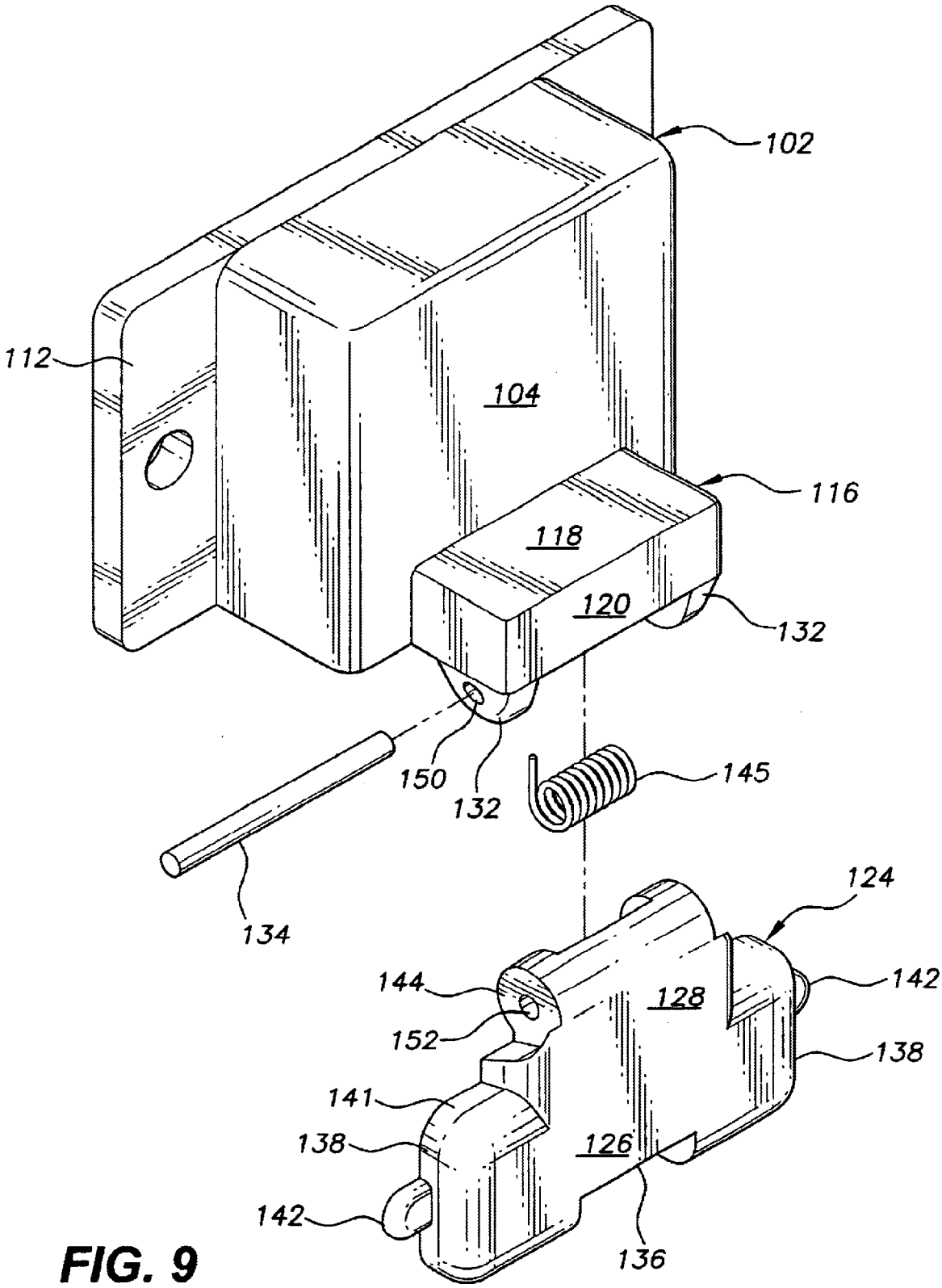
FIG. 9 is an exploded view of the plug protector of FIG. 6.
Figure 10A:
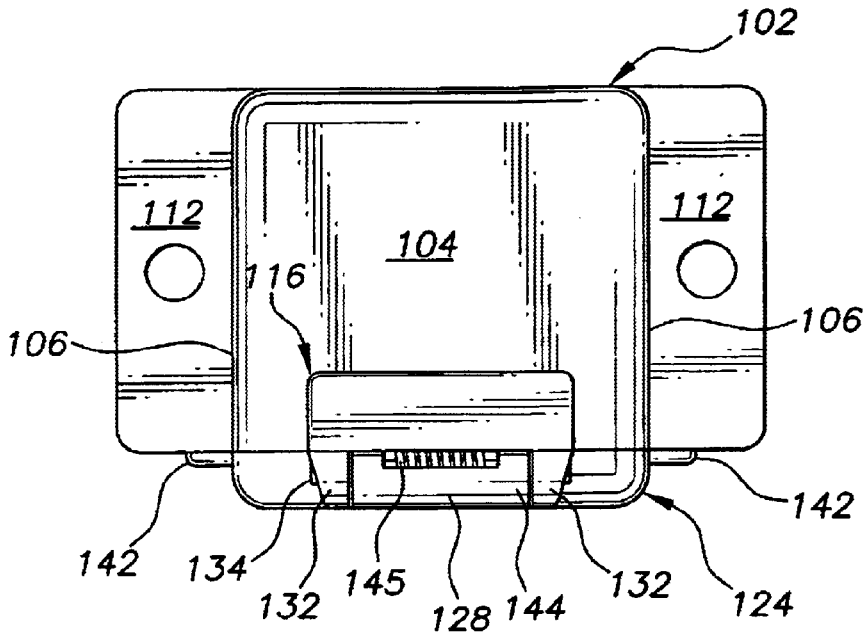
FIG. 10A is a front elevation view of the plug protector of FIG. 6 with the cover in the closed position.
Figure 10B:
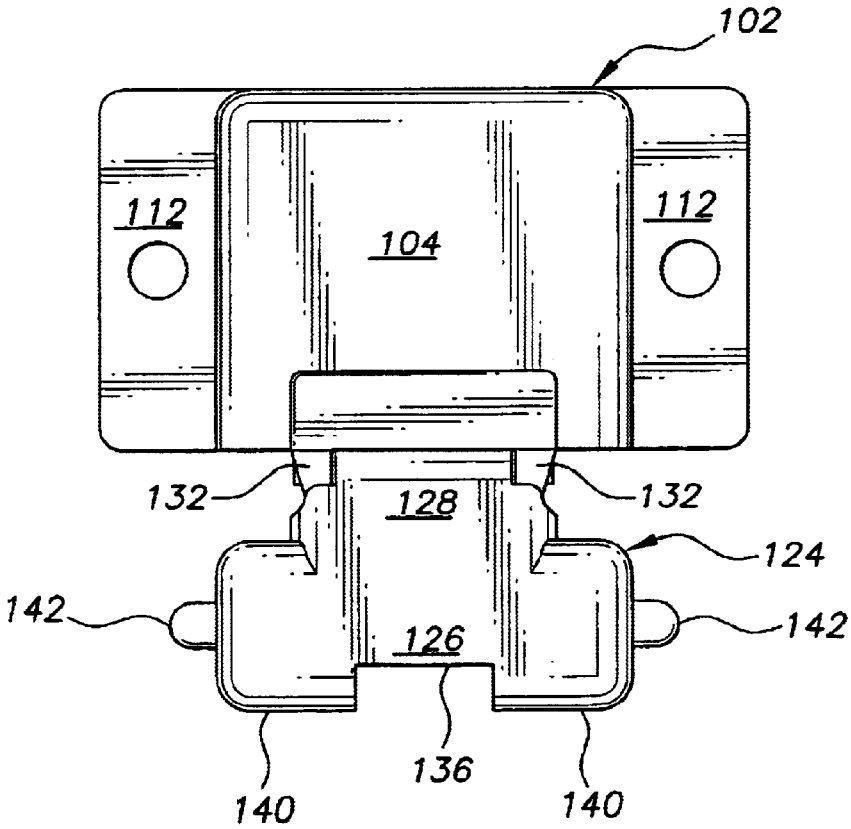
FIG. 10B is a front elevation view of the plug protector of FIG. 6 with the cover in the open position.
Figure 11A:
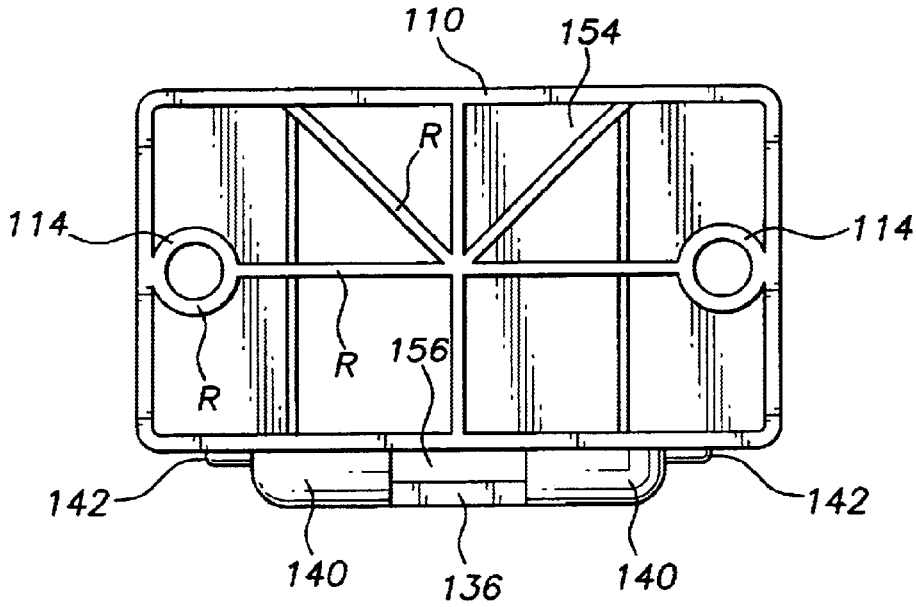
FIG. 11A is a rear elevation view of the plug protector of FIG. 6 with the cover in the closed position.
Figure 11B:
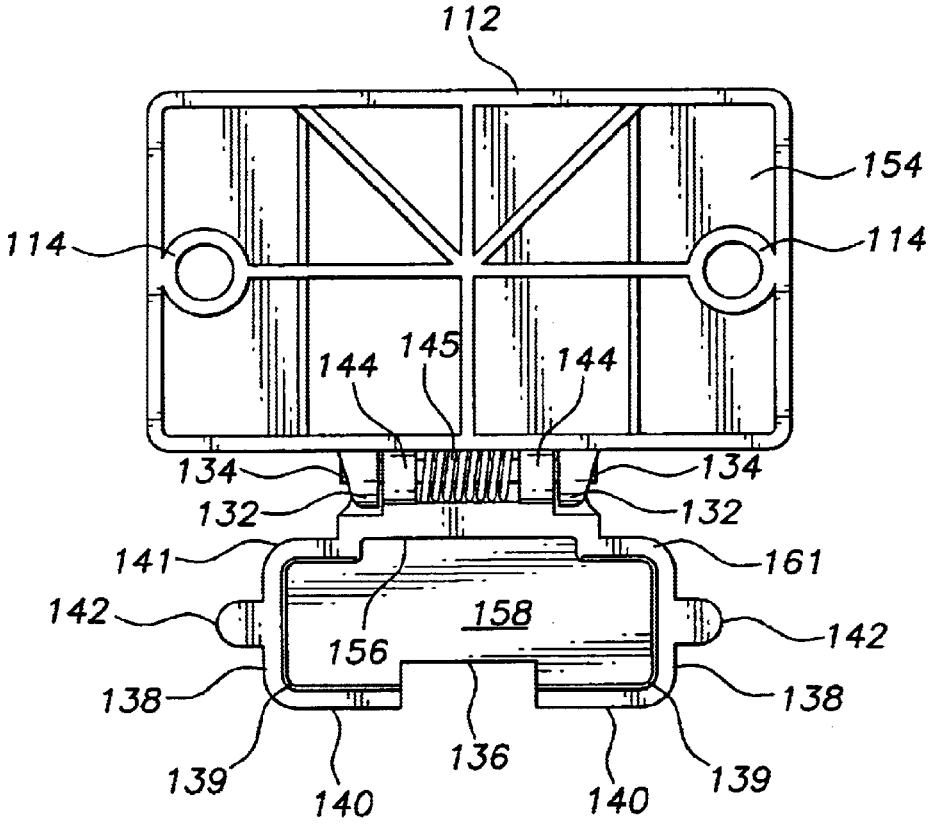
FIG. 11B is a rear elevation view of the plug protector of FIG. 6 with the cover in the open position.

As seen in FIGS. 9 and 11B spring 145 extends around hinge pin 134 between cover inner hinges 144 and is secured at one end and bears against a groove (not shown) in the end of hinge housing lower wall 148 of cover hinge extension portion 128 so as to exert closing force to cover 124, to keep it closed against plug receiver lower surface 160. The user may open the plug receiver 102 by pulling downward on tabs 142 to insert or remove plug LP. As seen in FIG. 7, hinge housing 116 has an inner upright wall 146 and a lower wall extending outward from inner wall 146. As seen in FIG. 9, hinge pin 134 extends through outer hinge bores 150 and cover hinge bores 152.

As best seen in FIGS. 7 and 11B, cover portion 126 has a hollow inner side shaped to receive the plug LP defined by inner peripheral wall surface 156 surrounding inner cover surface 158 and has an upper wall surface 161 which closes against plug receiver lower surface 160. Partial rims 139 extend upward from cover inner peripheral wall 156 at side walls 138, end walls 140, and shoulders 141 and extend upward along the inner walls of plug receiver 102 to form a dust barrier when cover 126 is in the closed position. As seen in the bottom view, FIG. 12B, plug receiver 102 has an upper wall surface 162 and a forward curving hinge housing inner wall 164.

As best seen in FIGS. 11A and 11B, mounting plate 110 preferably has reinforcing ridges R extending rearward from rear surface 154 surrounding the rear of the mounting plate and mounting bores 114, and crossing the rear surface of the mounting plate for reinforcement while saving material and weight.

In operation, cover 126 is opened downward by pulling downward on tabs 142 to the open position against the bias of spring 145. The linear plug LP, removed from the pulling vehicle socket, is pushed upward into the plug receiver 102 with the connectors pointing upwards. The spring biased cover is then allowed to close over the plug with the wiring harness WH extending downward through cover cutout 136. The plug and electrical connectors are thus protected from dust and the elements when not in use. To remove the plug for use, the cover is pulled downward with tabs 142 and the plug removed, the spring biased cover, upon plug removal, closing upward against plug receiver 102 thus keeping dirt or other matter from entering the unused plug protector.

It is clear from the forgoing discussion that the 4/5 way plug protector can be used on both the tow vehicle and/or the trailer, and thus will accommodate both the male and female versions of the 4/5 way plug.

It is to be understood that the present invention is not limited to the sole embodiments described above, but encompasses any and all embodiments within the scope of the following claims.

I claim:

1. A male plug protector for trailer wiring, comprising:

a vertically oriented, rectangular plug receiver having a front wall, opposing side walls, a closed top wall and a mounting plate opposing said front wall, said plug receiver being open at a lower end thereof for receiving a linear, generally rectangular male plug;

a lower cover for covering said plug receiver lower end; and a spring-biased hinge attaching said lower cover and said plug receiver lower end; said lower cover being rotatable at said spring-biased hinge between a vertical open position and a horizontal closed position, said cover being spring-biased to the closed position;

said rectangular plug receiver and said lower cover being of such dimensions and configuration to receive a linear, generally rectangular male plug;

whereby said lower cover is rotated downward from the closed position to the open position by a user, said male plug is inserted upward into said plug receiver, and said lower cover is allowed to close over the plug by said spring bias while allowing the wiring harness to extend downward from the closed cover.

2. The male plug protector of claim 1, wherein said lower cover defines a cutout therethrough for receiving said wiring harness.

3. The male plug protector of claim 2, said plug receiver mounting plate has extension portions extending outward, horizontally from each respective plug receiver side wall, each said mounting plate defining a mounting bore therethrough for receiving a mounting screw.

4. The male plug protector of claim 2, wherein said lower cover has an upper peripheral surface and said plug receiver has a lower peripheral surface corresponding with said lower cover upper surface for mating closure therewith.

5. The male plug protector of claim 4, wherein said lower cover upper peripheral surface has an inner lip for sealing against inner sides of said walls of said plug receiver lower peripheral surface forming a seal against entrance of dust or water into said male plug protector when in a closed position.

6. The male plug protector of claim 4, said plug receiver having a cover hinge housing extending outward and forward from a lower central portion of said front wall, said cover hinge housing having a common lower surface with said plug receiver lower peripheral surface and forming a front wall, an upper wall, and opposing side walls, each said side wall having outer hinge pin receiving portions of said hinge extending downward from the forward portion thereof.

7. The male plug protector of claim 6, said cover having a hinge extension portion corresponding with said cover hinge housing, said hinge extension portion defining outer grooves for receiving said outer hinge pin receiving portions of said cover hinge housing and having inner hinge pin receiving portions extending upward from the forward portion thereof spaced so as to rotatably bear against said outer hinge pin receiving portions of said cover hinge housing.

8. The male plug protector of claim 7, wherein said outer and inner hinge pin receiving portions define a pin bore having a hinge pin therethrough, said hinge pin having a biasing spring thereon extending between said inner hinge pin receiving portions, said biasing spring being so arranged as to form said spring-biased hinge connecting said plug receiver and said lower cover.

9. The male plug protector of claim 7, wherein said plug receiver is greater in width than said cover hinge housing and said cover hinge extension portion of said lower cover is coextensive with said cover hinge housing, said lower cover having shoulders extending from each side of said cover hinge extension portion such that said cover portion is coextensive with said lower surface of said plug receiver.

10. The male plug protector of claim 9, wherein said lower cover is recessed, having an inner peripheral wall and an inner cover wall for the lower end of said plug.

11. The male plug protector of claim 9, wherein said lower cover has outer side walls extending outward from said shoulders and an end wall, said end wall and said cover portion defining said cutout for receiving said wiring harness.

12. The male plug protector of claim 11, lower cover portion having tabs extending outward from said cover side walls for the user to engage when opening said lower cover for insertion or removal of said plug.

13. A male plug protector for trailer wiring, comprising:

a vertically oriented, rectangular plug receiver having a front wall, opposing side walls, a closed top wall and a mounting plate opposing said front wall, said plug receiver being open at a lower end thereof for receiving a linear, generally rectangular male plug;

a lower cover for covering said plug receiver lower end; and a spring-biased hinge attaching said lower cover and said plug receiver lower end;

said lower cover being rotatable at said spring-biased hinge between a vertical open position and a horizontal closed position, said cover being spring-biased to the closed position;

said rectangular plug receiver and said lower cover being of such dimensions and configuration to receive a linear, generally rectangular male plug;

said lower cover having an upper peripheral surface and said plug receiver having a lower peripheral surface corresponding with said lower cover upper surface for mating closure therewith;

said lower cover upper peripheral surface having an inner lip for sealing against inner sides of said walls of said plug receiver lower peripheral surface forming a seal against entrance of dust or water into said male plug protector when in a closed position;

said plug receiver mounting plate having extension portions extending outward, horizontally from each respective plug receiver side walls, each said mounting plate defining a mounting bore therethrough for receiving a mounting screw;

said lower cover portion having sidewalls and tabs extending outward from said cover side walls for the user to engage when opening said lower cover for insertion or removal of said plug;

whereby said lower cover is rotated downward from the closed position to the open position by a user, said male plug is oriented with the electrical contacts thereof pointing upward, said male plug is inserted upward into said plug receiver, and said lower cover is allowed to close over the plug as a result of said spring bias while allowing the wiring harness to extend downward from the closed cover.

14. A male plug protector for trailer wiring, comprising:

a vertically oriented, rectangular plug receiver having a front wall, opposing side walls, a closed top wall and a mounting plate opposing said front wall, said plug receiver being open at a lower end thereof for receiving a linear, generally rectangular male plug;

a lower cover for covering said plug receiver lower end; and a spring-biased hinge attaching said lower cover and said plug receiver lower end;

said lower cover being rotatable at said spring-biased hinge between a vertical open position and a horizontal closed position, said cover being spring-biased to the closed position;

said rectangular plug receiver and said lower cover being of such dimensions and configuration to receive a linear, generally rectangular male plug;

said plug receiver mounting plate having extension portions extending outward, horizontally from each respective plug receiver side wall, each said mounting plate defining a mounting bore therethrough for receiving a mounting screw;

said plug receiver having a cover hinge housing extending outward and forward from a lower central portion of said front wall, said cover hinge housing having a common lower surface with said plug receiver lower peripheral surface and forming a front wall, an upper wall, and opposing side walls, each said side wall having outer hinge pin receiving portions of said hinge extending downward from the forward portion thereof;

said cover having a hinge extension portion corresponding with said cover hinge housing, said hinge extension portion defining outer grooves for receiving said outer hinge pin receiving portions of said cover hinge housing and having inner hinge pin receiving portions extending upward from the forward portion thereof spaced so as to rotatably bear against said outer hinge pin receiving portions of said cover hinge housing;

said outer and inner hinge pin receiving portions defining a pin bore having a hinge pin therethrough, said hinge pin having a biasing spring thereon extending between said inner hinge pin receiving portions, said biasing spring being so arranged as to form said spring-biased hinge connecting said plug receiver and said lower cover;

said lower cover having shoulders extending outward from said hinge extension portion, outer side walls and an end wall, said end wall and said cover portion defining said cutout for receiving said wiring harness;

whereby said lower cover is rotated downward from the closed position to the open position by a user, said male plug is inserted upward into said plug receiver, and said lower cover is allowed to close over the plug by said spring bias while allowing the wiring harness to extend downward from the closed cover.

15. The male plug protector of claim 14, said plug receiver being greater in width than said cover hinge housing and said cover hinge extension portion of said lower cover is coextensive with said cover hinge housing, said lower cover having shoulders extending from each side of said cover hinge extension portion such that said cover portion is coextensive with said lower surface of said plug receiver.

16. The male plug protector of claim 15, wherein said lower cover defines a cutout therethrough for receiving said wiring harness.

17. The male plug protector of claim 16, wherein said lower cover has an upper peripheral surface and said plug receiver has a lower peripheral surface corresponding with said lower cover upper surface for mating closure therewith.

18. The male plug protector of claim 17, wherein said lower cover upper peripheral surface has an inner lip for sealing against the inner sides of said walls of said plug receiver lower peripheral surface forming a seal against entrance of dust or water into said male plug protector when in a closed position.

19. The male plug protector of claim 17, wherein said plug receiver mounting plate has extension portions extending outward, horizontally from each respective plug receiver side wall, each said mounting plate defining a mounting bore therethrough for receiving a mounting screw.

20. The male plug protector of claim 19, wherein said lower cover portion having side walls and tabs extending outward from said cover side walls for the user to engage when opening said lower cover for insertion or removal of said plug.

* * * * *